United States Patent [19]

Knoos

[11] Patent Number: 4,462,212

[45] Date of Patent: Jul. 31, 1984

[54] UNITARY HEAT ENGINE/HEAT PUMP SYSTEM

[76] Inventor: Stellan Knoos, 5933 Avenida Chamnez, La Jolla, Calif. 92037

[21] Appl. No.: 335,659

[22] Filed: Dec. 30, 1981

[51] Int. Cl.[3] ..... F25B 9/00; F02G 1/04

[52] U.S. Cl. ..... 60/526; 62/6

[58] Field of Search ..... 60/516, 517, 525, 526, 60/524; 62/6

[56] References Cited

U.S. PATENT DOCUMENTS

| | | | |
|---|---|---|---|
| 3,379,026 | 4/1968 | Cowans | 62/6 |
| 3,845,624 | 11/1974 | Roos | 60/517 |
| 3,858,802 | 1/1975 | Stobart | 60/517 |

OTHER PUBLICATIONS

Symposium Papers, "Future Alternatives in Residential/Commercial Space Conditioning," Jun. 12–14, 1980, Chicago, Ill., 4 pp.

*Primary Examiner*—Allen M. Ostrager

*Attorney, Agent, or Firm*—Fraser and Bogucki

[57] ABSTRACT

A system for providing thermal energy output at intermediate levels below about 120° C. uses both a conventional heat source input and an ambient heat source input to the hot and cold ends, respectively, of a Vuilleumier cycle machine. While converting thermal energy to work in both a heat engine process and a heat pump process, an intermediate working chamber integral with both processes is arranged to provide thermal output at the desired intermediate level. By maintaining the pressure ratio within predetermined limits and observing a number of temperature relationships desirably high coefficients of performance are provided with useful levels of output in a reliable system having long operating life.

21 Claims, 7 Drawing Figures

UNITARY HEAT ENGINE/HEAT PUMP SYSTEM

BACKGROUND OF THE INVENTION

This invention relates to systems having a high coefficient of performance (COP) in translating heat input to an intermediate output level suitable for such applications as central and residential heating. More particularly, this invention relates to heat pump systems, in which compression and expansion cycles of a compressible fluid are utilized to improve the COP by extracting heat from an ambient source.

The increased cost and lessened availability of traditional thermal energy sources (wood, coal and petroleum products) have caused investigations to be undertaken of a significant number of novel systems for achieving a higher coefficient of performance. There is a widespread need for intermediate level heating, by which is meant the range of temperatures usually employed for water, residential and central system heating. Conventional electrically driven heat pumps are employed for many air and water heating applications in which an intermediate heat level output is desired, because of the fact that a substantial energy contribution from ambient sources can be used. Although a significant improvement over conventional direct heating techniques, the COP based on power plant heat input still remains relatively low (e.g. of the order of 1.2), and when electrical generating and transmission losses are considered the COP is further reduced to values of 1.0 or less. Consequently, for some time prime movers have been used for direct driving vapor compression (Rankine) heat pump systems, and many installations currently employ diesel engines or Otto engines in these configurations. The net COP of these systems is still not desirably high, and substantial improvements in efficiency are highly unlikely for either the prime mover or the vapor compression (Rankine) heat pump device alone.

More recently, therefore, other workers in the art have considered the use of heat engines in conjunction with heat pumps for converting input energy into intermediate level heat. Examples of two such systems are provided in an article entitled "A Stirling Engine Heat Pump System" by M. L. Hermans and G. A. A. Asselman, published in the *Proceedings of the Thirteenth Inter-Society Energy Conversion Engineering Conference,* Volume 3, pp. 1830–1833 (1978). The laboratory systems described basically comprise an air-to-water Rankine heat pump driven by a Stirling heat engine and a somewhat modified system of the same type using a generator and a speed control arrangement. The COP for this laboratory system is stated to be in the range of 1.4 on a seasonal performance basis, with a maximum COP of approximately 1.5 derived at higher ambient temperature levels. The authors specifically point out, however, that redesign of the Stirling engine for this particular application is required, and that the working fluid sealing problem of the Stirling engine has still to be solved. Because central and residential heating systems are required to operate on a high reliability, long term basis with minimum maintenance expenditure, the Stirling engine does not appear at this stage to represent a viable alternative for intermediate temperature level output systems.

Other Stirling engine driven heat pump systems are described in the referenced article by Hermans et al. Further references are given in another article entitled "The Study Of The Gas Heat Pump System Driven By A Stirling Engine", by Y. Ishizaki et al, published in the *Proceedings of the Fourteenth Inter-Society Energy Conversion Engineering Conference,* pp. 2045–2049 (1979). This is a comparative study showing that the COP of the Stirling engine driven gas heat pump is higher than that of the Rankine and Otto cycles.

Without appearing to have considered intermediate level heating needs specifically, other workers have devoted attention to employment of the Vuilleumier cycle in heating and cooling systems. The Vuilleumier cycle, described first by Rudolph Vuilleumier in U.S. Pat. No. 1,275,507 (issued Aug. 13, 1918) and entitled "Method And Apparatus For Inducing Heat Changes" has certain significant advantages over the Stirling engine. As pointed out in the treatise "Stirling-Cycle Machines" by G. Walker, published by the Clarendon Press, Oxford University, 1973, at p. 134, the Vuilleumier machines "offer many alternative attractions on grounds of simplicity; lack of pistons and seals being the primary advantages". Machines utilizing the Vuilleumier cycle employ the cycling of various volume devices in predetermined phase relationships and with interchange of heat energy such that as work increases the hot end tends to get hotter and the cold end tends to get colder. Unlike the Stirling machine, mechanical energy is typically necessary to cycle the displacer elements, but because of the low differential pressures the amount of mechanical work that must be added to this thermodynamic system is not significant. As mentioned in the Vuilleumier patent the machine can be used for high temperature heating or for cooling, and in fact it has more recently been used in a number of miniaturized cryogenic refrigerator systems. What is referred to as a "duplex machine" comprising two Stirling engine mechanisms (pp. 108 and 109 of Walker) may be used as a "duplex gas-fired air-conditioning unit". In the Walker book, however, at page 134, the Vuilleumier machine is described as similar to the duplex Stirling-cycle engine, and the duplex machine on pp. 108 and 109 may in fact be regarded as of the Vuilleumier type.

A related disclosure is contained in an article entitled "Regenerative Gas Cycle Air Conditioning Using Solar Energy" by M. S. Crouthamel and B. Shelpuk, published by the National Technical Information Service as PB-270154 (Aug. 1975). This system is intended to function as a water cooler for air-conditioning applications, using a solar powered Vuilleumier cycle. The usage of solar energy to augment thermal output is a well understood expedient that has been widely considered in the scientific literature. Whatever the available thermal energy source, whether air, water, solar or ground, a heat pump system should be able to function with higher COP and preferably without the cost and complexity introduced by the use of separate systems, or the developmental problems inherent in machines such as the Stirling engine.

It is known in these Vuilleumier refrigerators to dump some thermal energy from the regenerator, as shown by U.S. Pat. No. 3,423,948, for the purpose of rejecting heat to ambient from the passing refrigerator fluid. This rejection is used in a minor amount to bias temperature changes in the cold direction, in the refrigerator type of application. As will be evident hereafter, however, the thermodynamic process must be viewed as a whole if useful output at intermediate temperature levels is to be derived with a COP in the range of 1.5 to 2.5. More specifically, the machine must be taken from the theoretical realm, in which the cycle may function in a fashion approaching the adiabatic, with low heat output, and placed in a practical context. In this context high specific heat output should be derived with high COP utilizing the thermal input derived from a fuel as well as the contribution from ambient sources to best advantage in a system which is inherently reliable.

SUMMARY OF THE INVENTION

In consideration of the foregoing problems and objectives, applicant has devised a unitary heat engine/heat pump system operating within the Vuilleumier concept, but so constructed and arranged that thermal energy output is derived at an intermediate level with a significant thermal energy gain relative to thermal input, using ambient sources for a substantial heat contribution.

In one example of a system, the chambers for the hot and cold displacers of the system are interconnected by a high efficiency regenerator device, and an intermediate portion of the regenerator is coupled through an external heat exchanger with the dually variable intermediate chamber between the hot and cold displacers. A thermal source coupled to the hot end of the system, and an ambient source coupled to the cold end of the system establish the nominal temperature limits at the hot and cold chambers and across the regenerator. The displacers are reciprocated in phase relation at a low rotational velocity (e.g. 4 to 10 rps) as thermal input is applied at the hot end. A heat exchanger coupled to the intermediate working chamber and an intermediate region of the regenerator derives significant thermal output at intermediate temperature levels from the work performed thereat. An in-line configuration of the displacers is so arranged that the swept volumes preferably overlap and the displacers approach contact at one point, to minimize dead space. This heat driven heat pump provides a coefficient of performance in the range of 1.5 to 2.5. Inasmuch as the system operates with a low speed drive, it is particularly suited for large size static installations, and it further has the basic advantages of the Vuilleumier machine in reliability and freedom from seal problems.

In accordance with the invention, the cyclically varying hot and cold chambers convert heat to work while the intermediate working chamber provides an opposing work cycle that ejects heat energy at intermediate temperature levels as useful output. To achieve useful gains in performance, with a degree of balance between the thermal energy inputs, the regenerator is selected to have an efficiency factor in excess of 0.98, preferably in the range of 0.995, and the pressure ratio $\pi$, between maximum and minimum pressures, is held in a relatively low range while the cold temperature $T_c$ is maintained above 243° K. Maintenance of these and other relationships places the thermodynamic system in an operating regime in which useful intermediate level output is maximized.

Further in accordance with the invention, the pressure ratio in the system is maintained at approximately 1.3, providing a high level of specific output without inducing severe and disturbing adiabatic temperature changes in the chambers. The temperature ratio in absolute temperatures, between the hot and the cold levels, is held in excess of 1.5, while the temperature ratio between the intermediate level and the cold level is maintained at less than about 1.50. Heat exchanger efficiencies at the hot and cold ends are preferably held in excess of 0.5 and at the intermediate level also in excess of 0.5. All such factors interrelate in contributing to the desired high COP.

BRIEF DESCRIPTION OF THE DRAWINGS

A better understanding of the invention may be had by reference to the following description, in which.

DETAILED DESCRIPTION OF THE INVENTION

Figure 1:
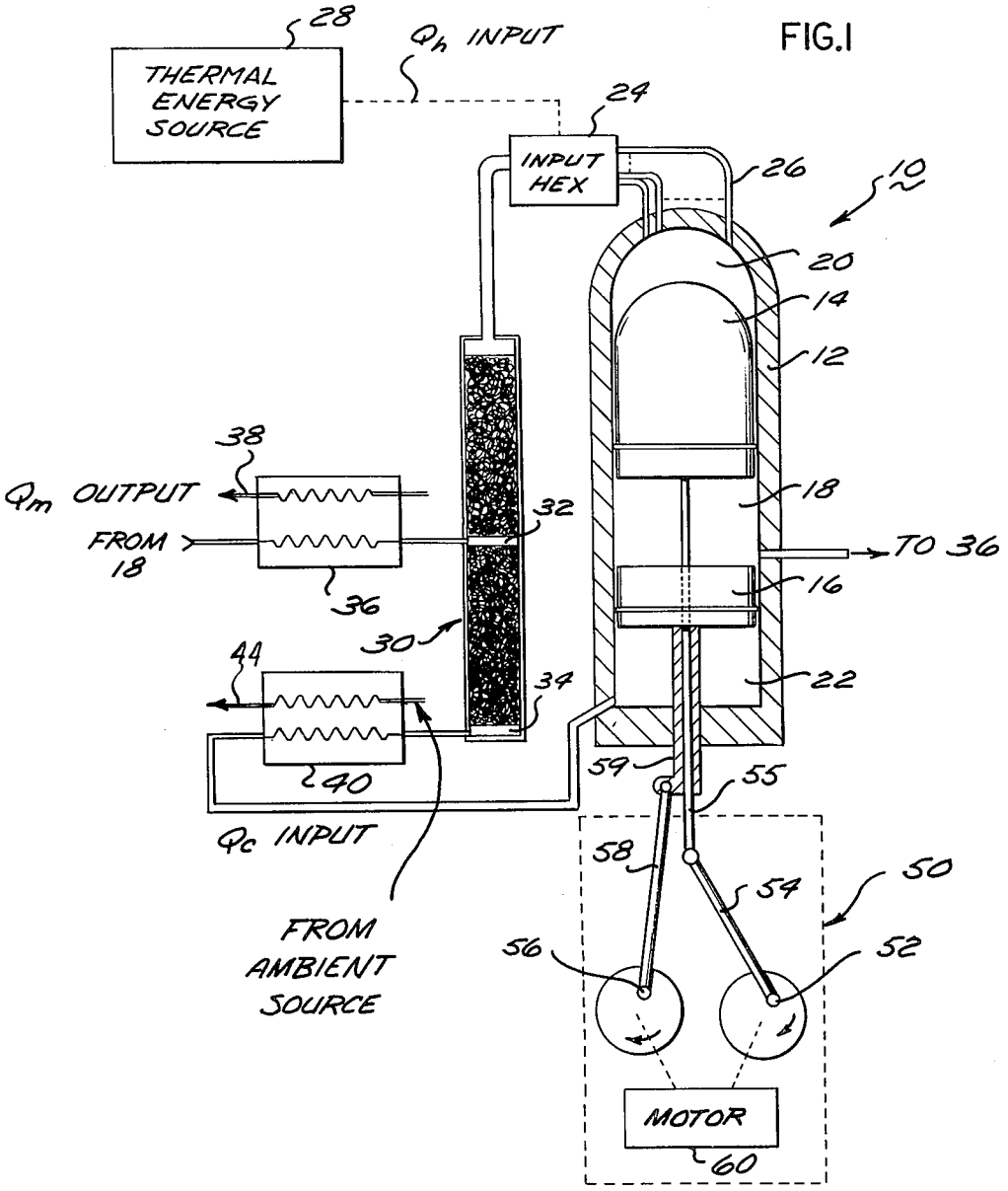
FIG. 1 is a schematic diagram of the principal elements of a system in accordance with the invention.

The principal elements of a unitary heat engine/heat pump system 10 in accordance with the invention are depicted in FIG. 1, and are shown in simplified form in accordance with conventional practice in this art. In the system 10, a housing 12 provides a thermal and pressure enclosure for a first or hot displacer 14 and a second or cold displacer 16. The displacers 14, 16 are coaxial in this instance for particular purposes mentioned below. However, other juxtapositions that are commonly used in prior art Vuilleumier systems may be employed for their particular advantages of cost or operation. The volume between the hot and cold displacers 14, 16 comprises the intermediate working chamber 18 while the volumes at the opposite ends of the housing 12 comprise the hot chamber 20 and the cold chamber 22 respectively.

The hot chamber 20 communicates working fluid (e.g. helium or hydrogen) with an input heat exchanger 24 comprising a plurality of heater tubes 26. A fuel burner or other thermal energy source provides high temperature input while consuming the non-renewal fuel used in the system. Waste heat from the input heat exchanger 24 may be used to augment thermal energy output from the system by being passed through a recuperator or heat exchanger for preheating or postheating purposes; such arrangements are conventional and therefore are not shown for simplicity.

The hot chamber 20 is intercoupled through the input heat exchanger 24 to the high temperature end of a high efficiency regenerator 30. As is explained in greater detail below, the regenerator 30 has an efficiency factor in excess of 0.98, which capability is currently achieved in known systems using meshes, screens, fiber mats, packed pebble beds and other expedients. The opposite end of the regenerator 30 is coupled to the cold chamber 32. A thermal gradient is established along the regenerator length, with added gas passageways being included at an intermediate temperature level region 32 and a cold temperature level region 34. A conduit couples the intermediate region 32 to one input of an intermediate level heat exchanger 36, and an output passageway 38 from the heat exchanger 36 extracts the useful heat output, $Q_m$, from the system. At the cold end of the regenerator 30, a heat exchanger 40 is coupled by a conduit 42 to the cold chamber 22. Water or some other medium from an ambient source is coupled through the opposite-going passageways 44, to provide available thermal energy input to the system. It will be recognized that the ambient source may alternatively utilize thermal energy available from a water (lake, river or ground water), ground or air source, or from a low or medium temperature heated solar source (e.g. flat collector). In addition, it will be recognized that the high temperature heat input may alternatively be derived from a solar concentrator system at appropriate times.

A coaxial displacer drive system 50 is coupled to reciprocate the hot and cold displacers 14, 16 respectively in selected phase relation. A hot displacer crank 52 and a cold displacer crank 56 of generally but not necessarily different lengths are each driven by a rotary source such as an engine or motor 60 through appropriate coupling mechanisms not shown in detail. A connecting rod 54 and displacer shaft 55 coupled to the hot displacer 14 through a central bearing aperture in the cold displacer 16 provide the reciprocating motion of the hot displacer 14 from the crank 52. A connecting rod 58 and a sleeve shaft 59 coupled to the cold displacer 56 concurrently reciprocate the cold displacer in the desired phase relation.

Figure 2:
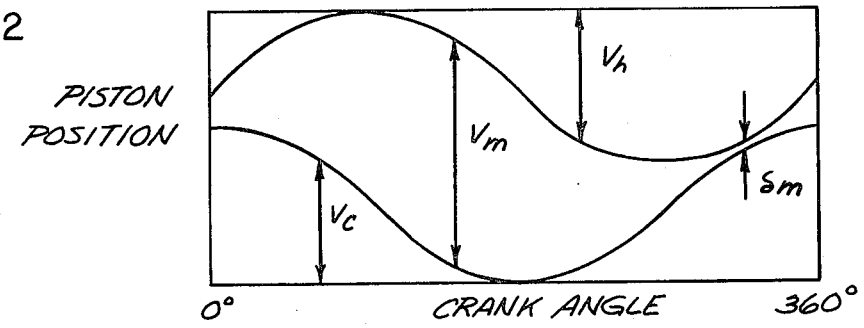
FIG. 2 is a diagram of piston position vs. crank angle useful in explaining the arrangement of the operation of FIG. 1.

The cyclic movements and generally different strokes of the displacers 14, 16 are depicted in FIG. 2, in which piston or displacer position are plotted against crank angle, and it may be seen that volume changes in the hot chamber lead those in the cold chamber, and that at different points in the cycle each of the hot and cold displacers 14, 16, enters the volume swept by the other displacer. Furthermore, at one point in the cycle, identified as $\delta_m$, the displacers 14, 16, come very close to contact. Although they may actually contact, this is not necessary mechanically and a small space between them at minimum separation suffices. The purpose of the overlapping relationship and small $\delta_m$ is to minimize system dead space and thereby maximize the heat output of the thermodynamic cycle.

It should also be appreciated that the volume between the hot displacer 14 and cold displacer 16 comprises the working chamber volume for the intermediate temperature level in this system and that the volumetric relationship changes in dependence upon the instantaneous positions of the two displacers 14, 16, as seen in the space between the two curves in FIG. 2.

In the operation of the system of FIG. 1, high temperature input energy from a thermal energy source 28 may be added continuously or with regular periodicity at the input heat exchanger 24 while the ambient low temperature heat source transfers thermal energy to the input passageway 44 of the cold level heat exchanger 40. Cycling of the hot and cold displacers 14, 16, then acts, in accordance with the Vuilleumier cycle, to establish a thermal gradient along the length of the regenerator 30. The extreme levels are controlled in general terms by the lower temperature ($T_c$) established by the ambient heat source at the passageway 44 and by the higher level ($T_h$) controlled by the thermal energy source 28. The temperature level ($T_m$) in the intermediate chamber 18 varies about an intermediate temperature level related to the temperature in mid-region 32 of the regenerator 30. This intermediate level temperature is controlled by the temperature conditions at the output passageway 38 from the intermediate level heat exchanger 36. The tendency of the cold chamber 22 to go colder is limited by the low temperature ambient heat source, and similarly any tendency of the hot chamber 20 to go colder is limited by the high temperature heat source.

At this point it can be seen that the overall structure defines a heat driven heat pump system, and particularly that apart from the minor amount of mechanical work input incidental to movement of the displacers there is no need for a prime mover driving a separate cycling system for a thermodynamic process. To derive useful levels of output under realistic conditions, however, certain criteria in accordance with the invention are to be observed as discussed below.

Certain characteristics of Vuilleumier machines are used in typical fashion, while other elements and relationships are substantially different, in machines in accordance with the invention, to arrive at a significantly different result. One characteristic of the Vuilleumier machine is that the phase angle between the displacers 14, 16, may be in the range of 70° to 100°, typically being about 90°. A low pressure differential exists across the seals and the displacers, essentially eliminating the internal sealing problems that are encountered, for example, with Stirling engines. The working gas is maintained at a moderate pressure, e.g. 40 to 100 bars ($4\times10^6$ to $10\times10^6$ Pa), but higher pressures up to 200 ($20\times10^6$ Pa) can be envisioned. The power input to the displacer drive system 50 to counteract displacer friction and flow friction for a well designed system can be kept in the range of two orders of magnitude smaller than the energy inputted into the system.

For energy outputs at intermediate temperature levels, however, the mechanical arrangement utilizes a number of features that contribute significantly to the overall result. In contrast to cryogenic refrigerator systems, the volumes swept by the hot and cold displacers 16 are here approximately equal. Large diameter displacers can be utilized and operated at slow speeds, for example from 4 to 10 revolutions per second. Such large slow elements, with minimal internal seal problems, provide the basis for extremely long term service-free operation (e.g. more than 20,000 hours) that is desired for long term heating operations.

Figure 3:
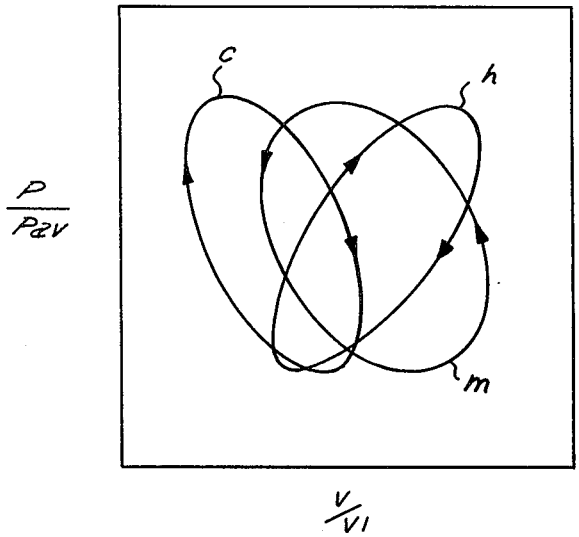
FIG. 3 is a diagram of normalized pressure vs. volume relationships in operation of the system of FIG. 1.
Figure 6:
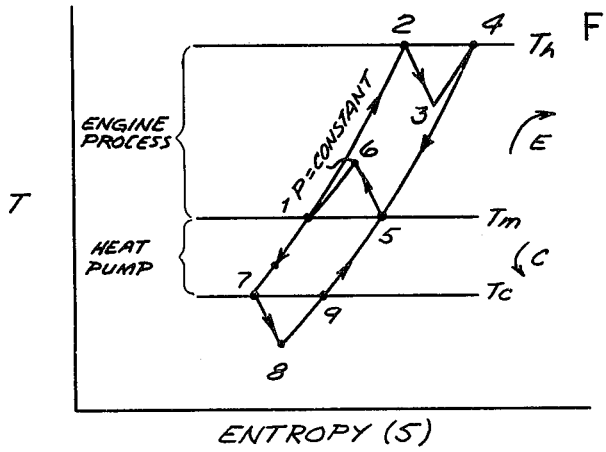
FIG. 6 is a graph of temperature vs. entropy useful in describing the operation of systems in accordance with the invention.

The factors that are operative in the thermodynamic process require not only a degree of balancing but also optimization of different operative factors to achieve the desired results. The pressure-volume diagrams of FIG. 3 for the three work chambers are normalized by being presented with $p/p_{average}$ as the ordinate and $V/V_1$ as the abscissa, where $V_1$ is the volume swept by the hot displacer 14. In general terms, the hot and cold displacers 14, 16 of FIG. 1 generate P-V diagrams for the hot (h) and cold (c) temperature levels that both run clockwise and are of approximately equal integral area on the P-V diagram. The intermediate chamber (m), however, provides an anti-clockwise P-V diagram with an integrated area, and therefore heat output, which is substantially equal to the sum of the described P-V integrals for the hot and cold chambers. The manner in which the heating in the hot and cold chambers 20, 22 of FIG. 1 is converted to net pressure-work input in the working chamber 18, and thus into heat output at intermediate level, may be further understood from the temperature-entropy diagram of FIG. 6. In FIG. 6, the temperature level $T_h$ defines the temperature level which tends to be maintained in the hot chamber 20, and the temperature range from $T_h$ down to $T_m$ represents what may be called the engine process in the system. $T_m$ again is the level which is tended to be maintained in the intermediate chamber 18. The level $T_c$ represents the characteristic level of the cold chamber 22, and the temperature range between $T_m$ and $T_c$ relates to the heat pump function of the system. The thermodynamic changes occurring within the system are along the two major boundary curves, which represent two different pressure levels. FIG. 6 illustrates initially that assuming other factors could be idealized, the system would approach the efficiency of the Carnot process if the constant pressure lines approach each other (i.e. the pressure ratio $\pi$ approaches 1.0). The closer the Carnot process is approached, the higher the actual COP will be, in the theoretical case. In actuality, however, many other factors must be considered, and if the pressure ratio is too low (e.g. near 1.0) the specific heat output of the system is also too low, so that this approach is impractical.

Figure 4:
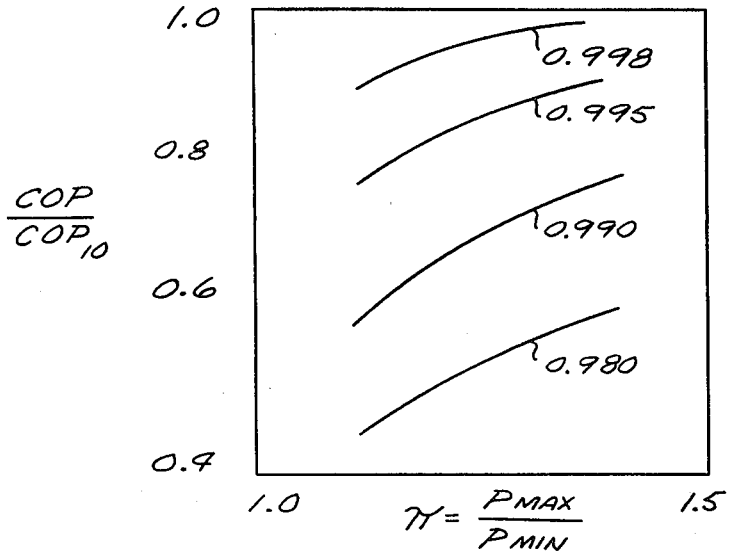
FIG. 4 is a graph of variations in the ratio of COP to the ideal COP with respect to pressure differential, for differrent regenerator efficiencies.

In FIG. 6, a convenient starting point for the cycle is identified as the regenerator temperature at point 1, level $T_m$, which in the engine (upper) process proceeds upwardly along the left hand constant pressure line to the maximum temperature $T_h$ at point 2. This corresponds to flow through the regenerator and to the increase in regenerator temperature along its length under steady state conditions. The temperature entering the hot chamber is also $T_h$ (point 2). Gas mixing and expansion moves the thermodynamic state to point 3 (lower pressure and lower temperature). In the succeeding part of the cycle, gas is leaving the hot chamber, flowing through the input heat exchanger 24, where heating to the $T_h$ level occurs, as shown in FIG. 4. The regenerator thereafter cools the gas along the constant pressure line to the $T_m$ level, point 5. Finally, the "engine" gas is compressed to the original higher pressure level and mixed with gas already present in the intermediate working chamber, with the process going to point 6. Upon leaving the intermediate chamber 18, the gas passes through the intermediate level heat exchanger 36, giving up a quantity of thermal energy $Q_m$ in returning to point 1. The heat addition 3-4 and heat rejection are strongly dependent upon the difference between the maximum and minimum working pressures (and thus $\pi$ in the system). It will be shown that the value of $\pi$ is subject to other constraints and relationships.

In somewhat corollary fashion, the heat pump (lower) portion of the system also deviates from the Carnot process in dependence upon the pressure ratio $\pi$. The gas flowing to the cooler part of the regenerator, starting from point 1, goes to point 7 at the cold chamber 22 level $T_c$. When expansion occurs in the cold chamber 22, the pressure and the temperature both decrease, with the thermodynamic state going to point 8. Heat added from the cold heat source returns the gas to the $T_c$ level at point 9. The gas then returns through the regenerator along the lower constant pressure line to point 5, here joining gas from the upper (engine) loop to reach point 6 and giving up thermal energy to the heat exchanger in returning to point 1.

In other words, the three triangular portions 2-3-4; 5-6-1; and 7-8-9 of the diagram of FIG. 6 represent adiabatic temperature changes associated with a finite $\pi$ ratio and negatively affect the COP value. With large pressure ratios, e.g. greater than 1.5, the temperature swings within the three chambers constitute adiabatic variations that inordinately reduce the COP to unacceptable low levels. The actual temperature levels $T_h$, $T_m$ and $T_c$ of the gases in the various chambers, and the relationships between them, are of primary importance in achieving a high COP. A useful maximum intermediate heat level for space heating could be set at approximately 120° C., because higher than this would place overly stringent requirements on conduits and equipment for air, pressurized water and like heating applications. More typically, a range of 50° to 80° C. is desired for the temperature of the intermediate level output. In accordance with the invention, useful amounts of thermal energy contribution from ambient sources such as water, air, ground or solar sources can generally not be derived at temperatures less than 243° K. (−30° C.).

Figure 5:
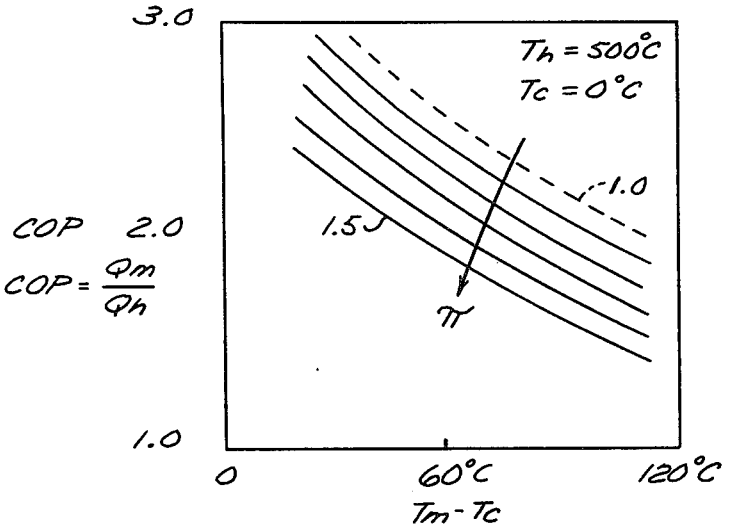
FIG. 5 is a graph of variations in COP with respect to selected temperature differentials for a range of pressure ratios.

FIG. 5 illustrates that the COP varies both with the pressure ratio $\pi$ and with the temperature differential $T_m - T_c$. This example assumes that the hot temperature level is in the range of 500° C. and that the cold temperature level $T_c$ is approximately 0° C. The general rule depicted by the curves of FIG. 5 is that the lower the temperature differential ($T_m - T_c$) and the lower the pressure ratio under these conditions, the higher will be the COP. This relationship arises not only because of the factors pointed out relative to FIG. 6, but also because of the relatively greater thermal energy contribution from ambient sources as $T_m - T_c$ decreases. It is obvious that a temperature differential which approaches zero is not a meaningful case, inasmuch as the intermediate level output then is substantially no different from the ambient source. To obtain useful specific heat outputs with a meaningful temperature differential, in the range of 60° to 80° from an ambient heat source that may be as low as −30° C., a $\pi$ value in the range of 1.10 to 1.50, with a general practical optimum in the range of 1.30, and a temperature differential in the range of 60° to 80° C. are desirable.

In this thermodynamic process for providing heat output in intermediate temperature levels, it can be seen that the regenerator 30 is the central part of the machine. Because of the balanced and highly regenerative operation, extracting heat from both an engine process and a heat pump process, a high COP demands a very high thermal efficiency regenerator. As seen in FIG. 4, in which variations of the ratio of the COP to ideal COP are plotted as the ordinate against values of $\pi$, at least two factors should be observed. First is that the regenerator thermal efficiency factor should be in excess of 0.98 and second that material benefits are obtained by utilizing a regenerator construction having an efficiency factor in the range of 0.995 and above. Also, the value of $\pi$ has a generally inverse relationship to the COP, in that at low values of $\pi$ the regenerator inefficiency is more important. For this reason also, the specified range of values of $\pi$ is significant. This condition as to regenerator efficiency can be readily satisfied using prior technology developments in Vuilleumier and other cryogenic refrigerators, because fine filament or fine mesh systems having large wetted areas and multiple small passageways with very small "hydraulic diameter" provide the needed range of efficiencies, and in a careful proper design should thoroughly wet without introducing excessive pressure drop.

Figure 7:
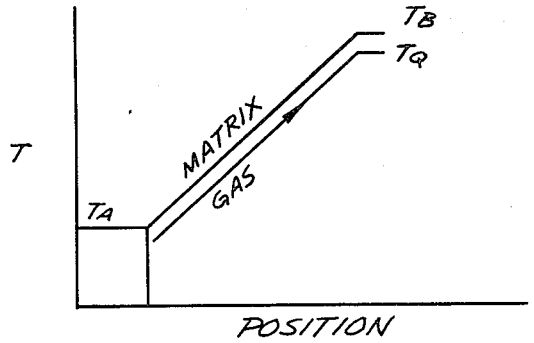
FIG. 7 is a graph of temperature vs. position along the length of a regenerator used in the system of FIG. 1 showing temperature gradients therein as related to the efficiency factor of the regenerator.

FIG. 7 depicts, as a plot of temperature against position along the regenerator matrix, the conditions defining the regenerator efficiency factor. For cold and hot temperature matrix levels $T_A$ and $T_B$ respectively, the hot level temperature of a gas, $T_G$, flowing through the matrix should have a small differential from the highest matrix temperature $T_B$. The regenerator temperature efficiency factor may therefore be defined as follows:

$$\eta = 1 - \left(\frac{T_B - T_G}{T_B - T_A}\right)$$

The importance of the relationship between $T_m$ and $T_c$ is subject to another constraint, in that the ratio $T_m/T_c$, in absolute temperature (Kelvin) values, should be less than 1.5. Conversely, the ratio between $T_h$ to $T_c$ in absolute temperature (Kelvin) value should be greater than 1.5. While it will be recognized as generally true that the higher the level of $T_h$ the more efficient will be the thermodynamic process, it must also be recognized that excessively high temperatures present other problems, including the requirements for temperature resistant materials that have been encountered with Stirling engines. The efficiency requirements noted as to the regenerator, however, do not pertain to the input heat exchanger 24, the intermediate level heat exchanger 36 and the cold level heat exchanger 40, however, although these should all be in excess of at least 0.50 and preferably in excess of 0.70. The derivation of useful heat $Q_m$ (per cycle) from the system is not independent of temperature level, but temperature level can be varied conveniently simply by changing the external loop conditions, e.g. the mass flow rate of the heat accepting fluid flow. Thus, if the intermediate level heat exchanger 36 is utilized as a gas-to-liquid exchanger, then the temperature of the liquid output can be increased simply by reducing the rate of liquid flow through the system (or other external loop property).

Those skilled in the art will recognize that other configurations of Vuilleumier systems may also be used, such as the orthogonal chambers with displacers coupled to a common crankcase shown, in U.S. Pat. No. 3,423,948 mentioned above. The displacers may be arranged in in-line opposed fashion and driven from the alternate ends of the housing. Further, rotary and oscillatory members may be used to provide cyclic variations within a machine housing. The Vuilleumier machine may also be operated to provide the power needed for movement of the displacers. All such configurations and others can be employed in an integral heat engine/heat pump system in accordance with the invention.

While various modifications and variations have been suggested above, it will be appreciated that the invention is not limited thereto but encompasses all forms and exemplifications within the scope of the appended claims.

What is claimed is:

1. A heat driven heat pump system comprising:

a thermodynamic system having a cold chamber, a hot chamber and an intermediate working chamber, a working fluid within the chambers, regenerator means intercoupling the hot and cold chambers to establish a thermal gradient therebetween, means coupled to said hot and cold chambers for varying the volumes thereof in cyclic fashion to induce pressure and temperature changes in the working fluid in the hot and cold temperature chambers respectively, and means intercoupling the hot chamber and regenerator means for adding thermal energy to the working fluid; and heat exchanger means coupled to the intermediate working chamber and a selected intermediate region of the regenerator means for extracting thermal energy from the working fluid thereat;

wherein the pressure ratio between maximum and minimum pressures in the working fluid is between 1.1 and 1.5 and the ratio of the absolute temperatures of the hot and cold chambers is in excess of 1.5, such that an ambient source contributes heat to working fluid at the cold temperature and the coefficient of performance between the thermal input at the hot chamber and the output at the intermediate working chamber is in excess of 1.4.

2. The invention as set forth in claim 1 above, wherein the thermodynamic system comprises a Vuilleumier system, and wherein the means for varying the chamber volumes comprises mechanical members within the chambers for varying the interior volumes, and drive means coupled to said mechanical members for displacing them in phased relation.

3. The invention as set forth in claim 2 above, wherein the regenerator efficiency factor is in excess of 0.98.

4. The invention as set forth in claim 3 above, wherein the ratio of the absolute temperatures of the intermediate working chamber and the cold chamber is less than approximately 1.5, and wherein the temperature of the cold chamber is in excess of 243° K.

5. The invention as set forth in claim 4 above, wherein said mechanical members comprise pistons reciprocable within the cold chamber and hot chamber, and wherein the drive means coupled to operate the pistons operates at less than 10 rps.

6. The invention as set forth in claim 5 above, wherein the pressure ratio is approximately 1.3 and the temperature efficiency factor of the regenerator is approximately 0.995.

7. The invention as set forth in claim 6 above, including in addition second heat exchanger means having an efficiency factor in excess of 0.5 coupling the regenerator to the hot chamber, third heat exchanger means having an efficiency factor in excess of 0.5 coupling the regenerator to the cold chamber, and wherein the heat exchanger means coupled to the intermediate working chamber has an efficiency factor in excess of 0.5.

8. The invention as set forth in claim 7 above, wherein the efficiencies of the heat exchanger means, second heat exchanger means and third heat exchanber means are all in excess of 0.7.

9. A system for generating heat output at intermediate temperature levels comprising:

a Vuilleumier system having a hot end displacer device and a cold end displacer device intercoupled by a regenerator and cycling a working fluid;

high temperature level heat source means coupled to the hot end displacer device;

ambient level heat source means coupled to the cold end displacer device;

intermediate working chamber means in communication with both the hot end displacer and cold end displacer; wherein the hot end displacer device and cold end displacer device operations both define P-V curves which cycle in a given sense to convert heat input to work, and the P-V curve defined by the variations in the intermediate working chamber varies in the opposite sense to convert work inputted from both the hot end and cold end displacer devices to thermal energy in a temperature range up to 120° C.

10. The invention as set forth in claim 9 above, wherein the pressure ratio in the working fluid is limited to reduce adiabatic temperature variations in the displacer devices and the intermediate working chamber means.

11. A integral heat engine/heat pump system providing thermal energy as output at a temperature level below approximately 120° C., comprising:

first and second displacer means each interacting with an intermediate working chamber and each operating in a first or second working chamber respectively to cycle a working fluid therein;

heat source means coupled to the first working chamber to tend to maintain the first working chamber at a temperature $t_h$;

ambient heat source means coupled to the second working chamber to tend to maintain the second working chamber at a temperature $t_c$;

regenerator means coupling the first working chamber to the second working chamber and providing a thermal gradient therebetween, an intermediate region of the regenerator means being coupled to the intermediate chamber to communicate working fluid therewith; and means in communication with the intermediate working chamber for extracting thermal energy therefrom at a temperature level below approximately 120° C.

12. The invention as set forth in claim 11 above, wherein the first and second displacer means and regenerator means are arranged to operate in a Vuilleumier cycle.

13. A system for providing intermediate level heat for residential and central heating purposes having a high coefficient of performance relative to input thermal energy and comprising:

a thermodynamic machine having hot and cold temperature chambers of cyclically varying volume, and an intermediate temperature level chamber whose volume varies in accordance with the volume differences of the hot and cold chambers, and a regenerator intercoupling the hot and cold chambers and providing flow of a working fluid therebetween, the intermediate level chamber being coupled to an intermediate region of the regenerator, whereby thermodynamic temperature changes are induced with the cold chamber tending to get colder;

means coupled to the hot chamber and the hot end of the regenerator for inputting thermal energy to system working fluid; and means coupled to the cold chamber and the cold end of the regenerator for contributing thermal energy in excess of 243° K. from ambient sources, and wherein the range of pressure variations in the ratio of the maximum to the minimum working fluid pressure variations is in the range of 1.10 to 1.50.

14. The invention as set forth in claim 13 above, wherein the ratio of the absolute temperatures of the hot chamber to the cold chamber temperature is in excess of 1.5 and wherein the ratio of the absolute temperatures of the intermediate level chamber to the cold chamber is below 1.5.

15. The invention as set forth in claim 14 above, including heat exchanger means coupled to the passageway between the cold chamber and the cold end of the regenerator for interchanging thermal energy from the ambient atmosphere, and heat exchanger means coupled to the intermediate region of the regenerator and the intermediate temperature level chamber for providing output thermal energy at an intermediate temperature level in the range of 80° C. to 200° C.

16. The method of operating a thermodynamic process to provide a high ratio of output and an intermediate temperature level to input at a higher temperature level while extracting available heat from an ambient source comprising the steps of:

cyclically varying the volumes of a working fluid within hot and cold temperature chambers serially intercoupled by a regenerator to establish a temperature gradient along the regenerator;

adding thermal energy to the working fluid between the hot chamber and the regenerator;

adding thermal energy from the ambient source to the working fluid between the cold chamber and the regenerator;

cyclically varying the volume of an intermediate temperature level chamber coupled to an intermediate region of the regenerator; and extracting thermal energy from the intermediate region of the regenerator, wherein the ratios of the absolute temperatures of the hot to the cold temperature chambers are in excess of 1.5 and wherein the ratio of the absolute temperature of the intermediate chamber to that of the cold chamber is less than 1.5.

17. The invention as set forth in claim 16 above, wherein the absolute temperature of the cold chamber is maintained in excess of 243° K. and wherein the range of maximum to minimum pressures in the chambers is 1.10 to 1.50.

18. The invention as set forth in claim 17 above, wherein the efficiency factor of the regenerator is in excess of 0.98.

19. The invention as set forth in claim 18 above, wherein external energy is supplied to cyclically vary the volumes of the working fluid.

20. The invention as set forth in claim 19 above, wherein the cyclic variation is below 10 rps.

21. The method of generating thermal energy for environmental heating purposes using an interconnected heat engine and heat pump having common working fluid comprising the steps of:

producing pressure-work output in the working fluid from the heat engine using a high temperature heat source, wherein the ratio of the heat engine maximum absolute temperature to the ambient absolute temperature is greated than 1.5;

producing pressure-work output in the working fluid from the heat pump using an ambient temperature heat source while controling the extent of adiabatic swings in the working fluid by limiting the pressure ratio to less than 1.5;

establishing a thermal gradient in the common working fluid between the heat engine and heat pump; and extracting thermal energy from the working fluid along the thermal gradient at a temperature of less than 120° C., wherein the ratio of the absolute temperature of the extracted energy to the absolute temperature is less than 1.5.

* * * * *